United States Patent [19]

Matsumoto et al.

[11] Patent Number: 4,512,748

[45] Date of Patent: Apr. 23, 1985

[54] MECHANICAL PENDANT

[75] Inventors: Hajime Matsumoto, Nagareyama; Yoichi Abe, Funabashi, both of Japan

[73] Assignee: Toybox Corporation, Tokyo, Japan

[21] Appl. No.: 470,480

[22] Filed: Feb. 28, 1983

[30] Foreign Application Priority Data

Mar. 1, 1982 [JP] Japan ..... 57-27121[U]

[51] Int. Cl.[3] ..... A63H 13/00

[52] U.S. Cl. ..... 446/354; 446/330; 446/352

[58] Field of Search ..... 46/116, 119, 126, 121, 46/149, 150, 163, 173; 446/72, 330, 363, 317, 352, 354, 390, 376

[56] References Cited

U.S. PATENT DOCUMENTS

| | | | |
|---|---|---|---|
| 3,411,237 | 11/1968 | Crosman | 46/119 |
| 3,837,113 | 9/1974 | Triska | 46/116 |
| 3,911,614 | 10/1975 | Terzian | 46/120 |
| 4,209,938 | 7/1980 | Orenstein | 46/116 |
| 4,244,138 | 1/1981 | Holahan et al. | 46/163 |

*Primary Examiner*—Robert A. Hafer
*Assistant Examiner*—Daniel Nolan
*Attorney, Agent, or Firm*—Staas & Halsey

[57] ABSTRACT

A pendant having a housing with a movable member connected to the housing. The movable member is capable of swinging movement for a period of time. The movement is started by the wearer compressing a movable driving arm toward a stationary projection formed in the lower part of the housing and then releasing. The driving arm is provided centrally with a spring normally biasing the driving arm away from the projection, and gear teeth at its upper end. The gear teeth mesh with a gear train terminating in a shaft having a disc and an eccentrically located projection extending toward the front of the pendant. The projection is engaged within a guide slot in the movable member which is rotatable about an axis contained in the housing. Thus, when the driving arm is compressed and released, the energy of the spring is transferred through the drive train, causing the eccentric projection to move the movable member to which it is connected, and thus imparting an animated character to the pendant.

7 Claims, 6 Drawing Figures

MECHANICAL PENDANT

BACKGROUND OF THE INVENTION

1. Field of the Invention

This invention relates to an amusement device, and more particularly to a pendant which is attractive in appearance, is capable of animated movement, and is also functional in use.

2. Description of the Prior Art

Mechanical pendants are known in the art which hang about a wearer's neck on a chain or string and which are capable of animated movement when a string is pulled to activate an internal mechanism. Such a device is disclosed in U.S. Pat. No. 4,245,486, issued to Matsumoto et al.

SUMMARY OF THE INVENTION

It is an object of the present invention to provide an amusement device which is attractive in color, shape and movement, which is capable of amusing animation instituted by the wearer, and whose function is useful.

It is another object of the present invention to provide a clip-on pendant having a wearer-energized actuating mechanism for moving a gear train within the pendant for creating extended animation of appendages, and thus creating attention and amusement.

To achieve the foregoing and other objects of the present invention, and in accordance with the purpose of the invention, there is provided a pendant having a housing and a facade. The facade comprises a movable member pivotally connected to the housing and being capable of swinging movement for a period of time, and a relatively stationary member. Movement of the movable member is started by the wearer compressing a driving arm against a projection formed on the lower part of the housing and then releasing the driving arm. The driving arm is provided with a spring normally biasing the driving arm away from the projection, and gear teeth at the upper end of the driving arm. The gear teeth are arranged to mesh with a gear train in the housing. When the driving arm is released, the motion is transferred through the gear teeth to the gear train, and finally to a shaft having an eccentric projection extending toward the front of the device. The eccentric projection is loosely engaged within a guide slot at the top of the movable member which is further rotatable about an axis on the housing. The rotating eccentric projection moves the movable member to which it is connected, and causes animation of the pendant.

Thus, the present invention provides a pendant which is attractive, amusing, functional and has animated action.

These together with other objects and advantages which will become subsequently apparent reside in the details of construction and operation as more fully hereinafter described and claimed, reference being had to the accompanying drawings.

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 4(*b*) is a front view of the substantially stationary member of the facade of the present invention; and FIG. 5 is a front view of the present invention, illustrating particularly the animation which this amusement device is capable of.

DETAILED DESCRIPTION OF THE PREFERRED EMBODIMENTS

For convenience of reference in describing this invention, "bottom" means in the direction from the housing toward the driving arm, top means in the direction away from the driving arm toward the housing, right means in the direction of the side of the housing having the projection, left is the side opposite the side having the projection, and front means in the direction from the housing to the plane having the facade located thereon.

Figure 1:
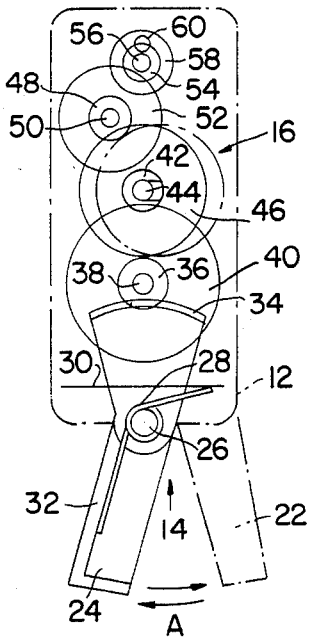
FIG. 1 is a front view of the internal mechanism of the present invention, illustrating particularly the driving arm, the projection, the gear train (schematically), and the housing.
Figure 3:
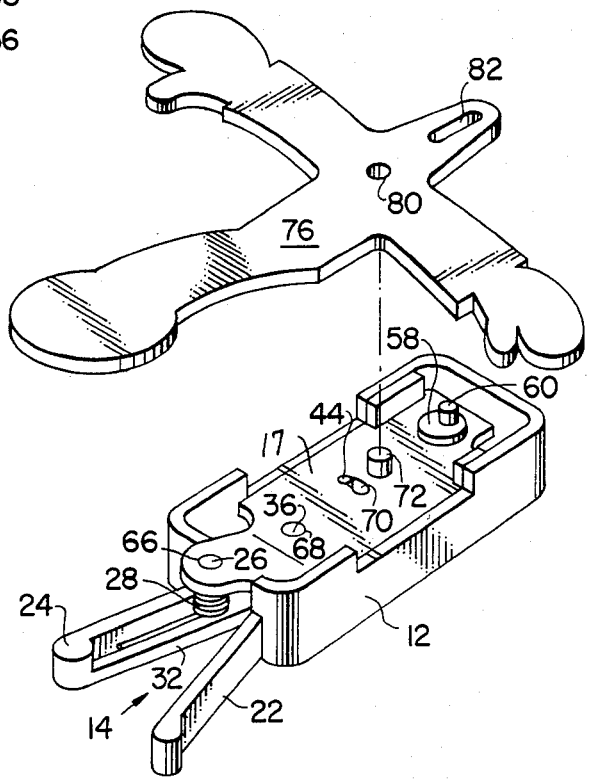
FIG. 3 is a perspective exploded view of the amusement device of the present invention, illustrating particularly the movable member of the facade, the driving arm, the projection and the housing.
Figure 5:
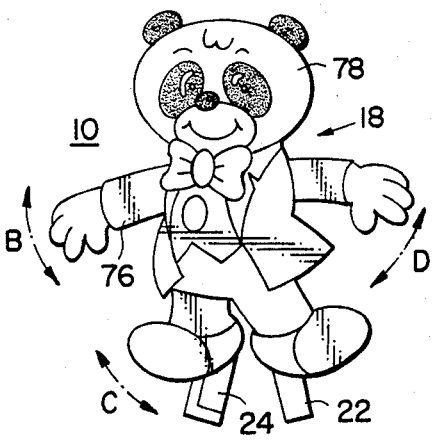

Looking at FIGS. 1, 3 and 5, reference numeral 10 indicates generally the pendant of the present invention. The pendant 10 comprises generally a housing 12, an actuating mechanism 14, a gear train 16, a middle plate 17 and a facade 18.

Figure 2:
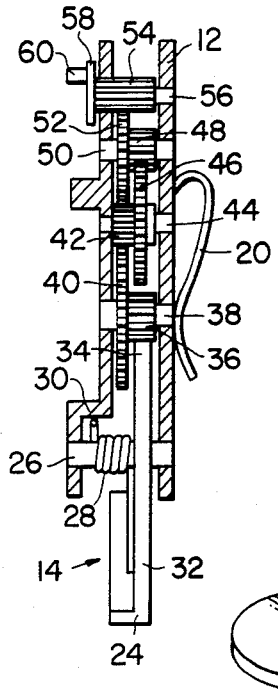
FIG. 2 is a side, cross-sectional view of the amusement device of the present invention, illustrating particularly the arrangement of the gears of the gear train within the housing.

As shown in FIGS. 1, 2 and 3, the housing 12 of the present invention is substantially rectangular and is equipped with a clip 20 at its back and a substantially flat, fixedly mounted projection 22 at its bottom.

The actuating mechanism 14 comprises a movable driving arm 24 pivotally connected to the housing by a shaft 26. The driving arm 24 also has a spring 28 mounted around the shaft 26 and biased against a ledge 30 on the housing 12 and a ledge 32 on the driving arm 24, such that the driving arm is normally biased away from the projection 22. The upper end of the driving arm 24 terminates in gear teeth 34. Gear teeth 34 mesh with the gear train 16.

The gear train 16 includes a pinion or first small gear 36 which is mounted on a first rotatable axle or shaft 38 and which meshes with gear teeth 34. A first relatively large gear 40 is coaxially mounted on shaft 38. The first large gear 40 meshes with a second pinion or small gear 42 mounted on a second rotatable shaft or axle 44, which is loosely positioned in an angular slot 45 (not shown) at the rear of housing 12 and an angular slot 70 (to be discussed later) in middle plate 17. Coaxially mounted to shaft 44 is the second large gear 46, which meshes with the third pinion or small gear 48 mounted on a third rotatable axle or shaft 50. Coaxially connected to shaft 50 is the third large gear 52, which meshes with the fourth and final pinion or small gear 54. The fourth small gear 54 is connected to the fourth and final axle or shaft 56, with one end terminating at the front of the housing in a disc 58 having a cam or an eccentrically positioned projection 60.

As shown in FIG. 3, the gear train components 34 through 54 in housing 12 are covered with a middle plate 17 having the disc 58 and eccentrically located projection 60 of the shaft 56 protruding through hole 64

(not shown) in the middle plate 17. The middle plate 17 also has holes 66 and 68 for receiving the front ends of shafts 26 and 36, respectively. An angular hole 70, loosely receives shaft 44. There is also located on the middle plate 17 a columnar projection 72.

Because shaft 44 is loosely positioned in both angular slot 45 in the back of the housing 12 and angular slot 70 in the middle plate 17, shaft 44 can move the distance of the angle making up each slot. That is, when the driving arm 24 is squeezed against the projection 22, gears 36 and 40 are caused to rotate in the clockwise direction, thus exerting pressure to the right upon gears 42 and 46, which are operatively connected to gear 40. This force on gears 42 and 46 causes the shaft 44 to move to the right in the angular slots 45 and 70 and causes gear 46 to move out of engagement with gear 48. Conversely, when the driving arm is released, gears 36 and 40 turn in the counterclockwise direction and exert a force on gear 46 to the left, which causes shaft 44 to return to the left side of angular slots 45 and 70, and causes gear 46 to again mesh with gear 48.

Therefore, when the driving arm 24 is squeezed, gear 48 is not moved because gear 46 is not meshing with gear 48, however, when the driving arm is released, gear 46 again meshes with gear 48 and transfers movement through the entire gear train 16.

The facade 18 comprises a movable member 76 and a relatively stationary member 78. In the preferred embodiment, the movable member 76 is configured to represent a left and right arm and a right leg. The stationary member 78 is configured to represent a head, a torso and a left leg.

Figure 4A:
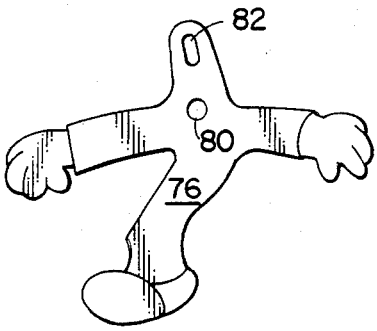
FIG. 4(*a*) is a front view of the movable member of the facade of the present invention.
Figure 4B:
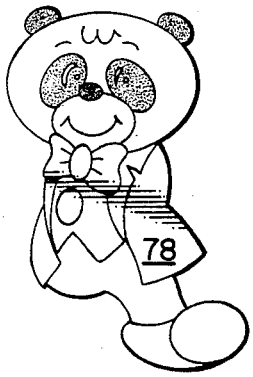

An example of a particularly attractive configuration of members 76 and 78 is shown in FIGS. 4(*a*) and 4(*b*). Of course, many different colors may be painted on members 76 and 78 and these members may take on almost an infinite number of shapes, e.g., animals, foods, etc.

The movable member 76 has a hole 80 positioned substantially centrally of the "arms" such that hole 80 receives projection 72 of the middle plate 17. In addition, projection 60 fits into a guide slot 82 located near the top of the movable member 76. The length of the guide slot 82 corresponds to the moving range of the eccentric projection 60 of shaft 56.

FIG. 5 shows the front view of the mechanical pendant completely assembled in accordance with the present invention, i.e., the gear train 16 and actuating mechanism 14 are positioned in the housing 12 substantially below the middle plate 17, and the facade 18 is operatively connected on the top of the housing 12 to the gear train 16.

The above-described assembled pendant is operated by compressing driving arm 24 toward projection 22 and then releasing to allow the spring biased driving arm 24 to expand. These movements are shown by arrow "A" in FIG. 1. After releasing the driving arm 24, the force of the relaxing spring 28 is transferred by gear teeth 34 to the gear train 16, which, of course, is caused to turn. With the ultimate rotation of disc 58, eccentric projection 60 moves in the guide slot 82 of the movable member 76 and causes a swing motion of the movable member 76 pivotally mounted to the middle plate 17. Therefore, the limbs on the movable member 76 of the mechanical pendant move as shown by the arrows "B", "C" and "D" of FIG. 5.

This motion continues until the driving arm 24 returns to its original position at the left side of the housing 12.

The device once animated, moves for a period of time with low noise, thus offering a pleasing effect. In addition, rapid, repeated compressions and expansions of the actuating mechanism provide continuous animated action. These effects, combined with a wide selection of designs and figures, provide a more amusing and greater attention-getting mechanical pendant than was known in the art.

The foregoing is considered as illustrative only of the principles of the invention. Further, since numerous modifications and changes would readily occur to those skilled in the art, it is not desired to limit the invention to the exact construction and operation shown and described, and accordingly, all suitable modifications and equivalents may be resorted to falling within the scope of the invention and the appended claims and their equivalents.

We claim:

1. An amusement device, comprising:

(a) a housing;

(b) gear means connected to the housing having a first end and a second end, the gear means including a plurality of gears and a one-way drive arrangement;

(c) a member movably mounted on the housing and being operatively connected to the first end of the gear means; and (d) compressible and expandable actuating means connected to the housing and being operatively connected to the second end of the gear means for moving the gear means and the movable member, the actuating means including (i) a fixedly mounted projection extending from the housing;

(ii) a driving arm having a first end and a second end, the first end being a free end and the second end terminating in gear teeth for meshing with the gear means and being pivotally mounted to the housing opposite the projection; and (iii) a spring connected to the driving arm normally biasing the driving arm away from the projection, wherein the gear means permits disengagement of at least one of the plurality of gears from the rest of the plurality of gears during compression of the actuating means such that the one-way drive arrangement allows the actuating means to be compressed without moving the movable member and yet will permit moving of the movable member when the actuating means expands.

2. The amusement device of claim 1, wherein the one-way drive arrangement comprises at least one small and one large gear mounted on a shaft, the ends of the shaft being loosely supported in angular slots located in the housing.

3. An amusement device, comprising:

(a) a housing;

(b) gear means connected to the housing having a first end and a second end, the gear means including a first gear;

a second gear mounted co-axially with the first gear and meshing with the third gear;

a fourth gear co-axially mounted with the third gear and meshing with a fifth gear;

the fifth gear being co-axially mounted with a sixth gear, which is positioned on a rotatable shaft terminating in a disc and having an eccentrically positioned projection extending away from the housing, (c) a member movably mounted on the housing and being operatively connected to the first end of the gear means; and (d) compressible and expandable actuating means connected to the housing and being operatively connected to the second end of the gear means for moving the gear means and the movable member, the actuating means including (i) a fixedly mounted projection extending from the housing;

(ii) a driving arm having a first end and a second end, the first end being a free end and the second end terminating in gear teeth for meshing with the first gear of the gear means and being pivotally mounted to the housing opposite the fixedly mounted projection; and (iii) a spring connected to the driving arm normally biasing the driving arm away from the projection.

4. The amusement device recited in claim 2, further comprising a stationary member positioned above the movable member on the housing.

5. The amusement device as in claim 4, wherein both the movable member and the stationary member are in the shape of appendages.

6. The amusement device of claim 4, wherein the movable member and the stationary member combine to form an animal figure, and the appendages thereof depict arms, legs, torso and a head of the figure.

7. A novelty device, comprising: a housing member formed with a desired shape, the housing having both a movable member and a stationary member and each of the movable member and stationary member having appendages extending therefrom; and a mechanism operatively connected to said housing, said mechanism including a plate attached to the housing and a plurality of gears mounted between the plate and the housing on rotatable axles, a cam affixed to one of said gears which is operatively connected to the movable member for actuating the movable member, and a compressible and expandable actuating means attached to the housing for energizing the plurality of gears and movable member, wherein said plurality of gears includes a pinion and gear mounted upon an axle, the ends of said axle being supported in angular slots provided in said plate and housing, respectively, to permit a one-way drive arrangement whereby when said actuating means is compressed the movable member will not be moved, and yet upon expansion of the actuating means, the one-way drive arrangement is engaged and the force of the actuating means is caused to operate through the plurality of gears, the cam and the movable member, to cause the movable member to move.

* * * * *